United States Patent [19]

Osburg et al.

[11] Patent Number: 4,484,736

[45] Date of Patent: Nov. 27, 1984

[54] DEVICE FOR STACKING SHEETS OF PAPER

[75] Inventors: Dieter Osburg, Neuss-Weckhoven; Peter Voss, Jüchen, both of Fed. Rep. of Germany

[73] Assignee: Jagenberg AG, Dusseldorf, Fed. Rep. of Germany

[21] Appl. No.: 349,944

[22] Filed: Feb. 18, 1982

[30] Foreign Application Priority Data

Apr. 9, 1981 [DE] Fed. Rep. of Germany ..... 3114414

[51] Int. Cl.[3] ..... B65H 29/14; B65H 31/02; B65H 31/20

[52] U.S. Cl. ..... 271/220; 271/200; 271/221; 271/299; 414/36

[58] Field of Search ..... 271/220, 198, 200, 221–224, 271/238, 240, 292, 293, 299; 414/35, 36, 900

[56] References Cited

U.S. PATENT DOCUMENTS

| | | | |
|---|---|---|---|
| 1,792,693 | 2/1931 | Johnson | 271/221 |
| 1,808,142 | 6/1931 | Labombarde | 271/240 |
| 2,065,503 | 12/1936 | Beck | 271/209 |
| 2,401,592 | 6/1946 | Von Stocker | 414/900 |
| 2,606,669 | 7/1952 | Morrison | 414/900 |
| 2,733,064 | 1/1956 | Martin | 271/224 |
| 3,191,929 | 6/1965 | Zernov et al. | 271/198 |
| 3,463,485 | 7/1969 | Atwood | 271/221 |
| 3,667,751 | 6/1972 | Zernov et al. | 271/221 |
| 3,992,001 | 11/1976 | Martin | 271/223 |
| 4,002,249 | 1/1977 | Shinomiya et al. | 271/200 |
| 4,346,882 | 7/1982 | Pessina et al. | 271/221 |
| 4,381,108 | 4/1983 | Newsome | 271/198 |

*Primary Examiner*—Bruce H. Stoner, Jr.
*Assistant Examiner*—James E. Barlow
*Attorney, Agent, or Firm*—Sprung, Horn, Kramer & Woods

[57] ABSTRACT

In the changing of the dimensions of sheets of paper to be stacked by a paper stacking apparatus including a conveying station, adjustable upper tapes moving about reflection rollers, separating shoes, ejector rolls, separating plates and stopper boards, the improvement which comprises displacing the upper tapes along with their deflection rollers, the separating shoes, the ejector rolls, and the separating plates all together transversely to the paper path. This is effected by providing a rod which connects the upper-tape deflection rollers, a separating shoe, ejector rolls, and a separating plate whereby they will all be transversely displaced together.

6 Claims, 2 Drawing Figures

DEVICE FOR STACKING SHEETS OF PAPER

Figure 1:
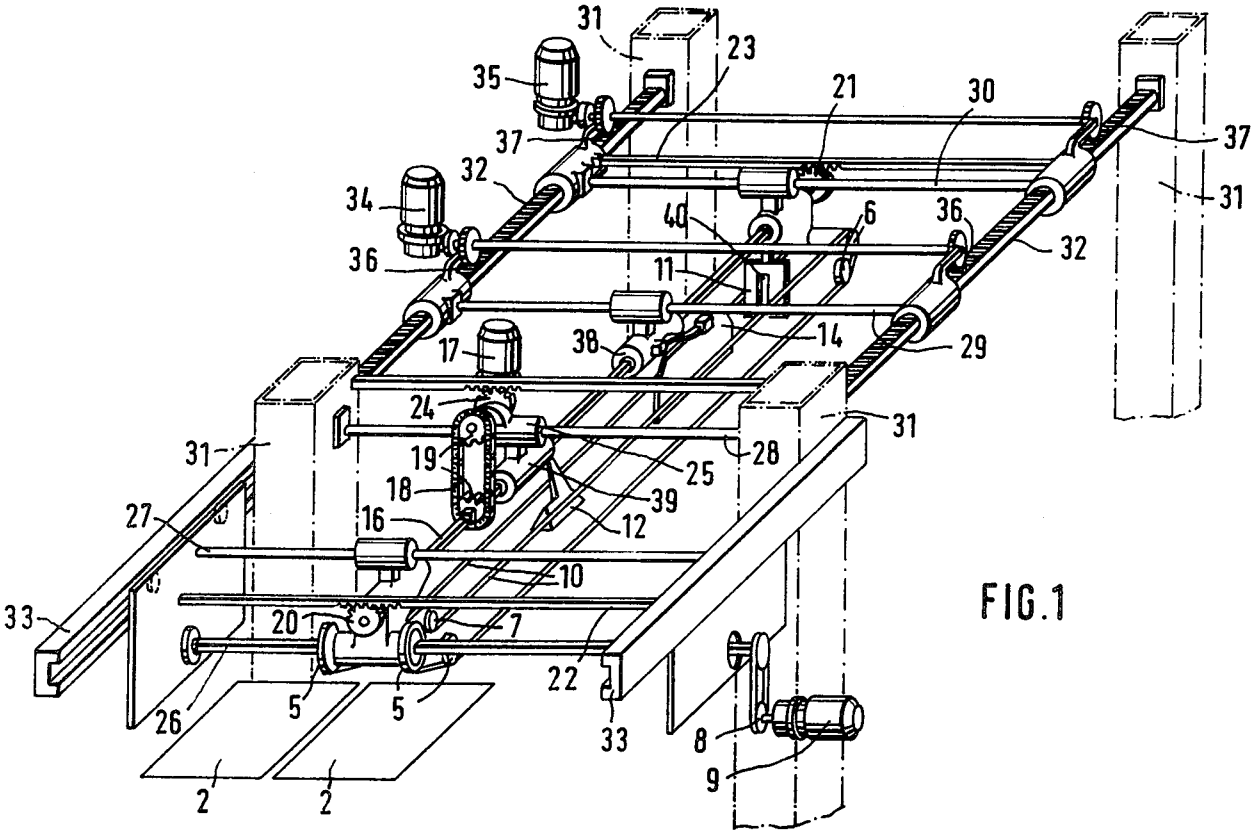

The invention is a method and device for adjusting the upper tapes, separating shoes, ejector rolls, separating plate, and stopper board to formats of different width and length in the stacking of sheets of paper conveyed to a stacking station.

Devices for stacking sheets of paper must be designed to be adjustable to formats of different width and length. This adjustment has up to now required very complicated and time-consuming manipulation because every component—separating shoe, separating plate, stopper board, etc.—of the device has had to be adjusted individually. It must also be kept in mind that these components must also be very carefully aligned with each other in their final positions. Since it is extremely difficult to do so when the separate components have to be adjusted individually, a machine may have to be stopped, readjusted, and started again after being adjusted to a new format when the first attempt is unsuccessful. This leads to disruptions in building up the stack and to unnecessarily long downtimes.

The goal therefore is to be able to adjust the paper-stacker components to their new position as rapidly as possible.

The present invention is intended as a device that permits all the components of a stacker to be adjusted at one time and for separate format width and length. The device in accordance with the invention is also intended to provide a wide range of formats. Adjusting the upper tapes along with their deflection rollers, the separating shoes, the ejector rolls, and the separating plates all at the same time will permit a new format width to be adjusted in minimal time, leaving the previously obtained precise alignment of these components unchanged, so that they will not have to be mutually readjusted.

The components can be displaced laterally by a single mechanism, especially a motorized mechanism, that is connected to each element in such a way that its position will not have to be changed when a format is changed. This is especially true of the separating shoe.

When the format length is adjusted it may be necessary to change the position of the separating plate in relation to the separating shoe as well as that of the stopper board in relation to the separating shoe and to the separating plate. This is simple to do in accordance with the invention because the stopper board is fixed on the downstream upper-tape deflection rollers and can be displaced along with them and with the upstream deflection rollers in the direction in which the sheets of paper are transported. In this design all the components, including the separating shoe, of the stacking device can also be displaced longitudinally or, in other words, along the paper path.

The device in accordance with the present invention is designed with the upper-tape deflection rollers, the separating shoes, the ejector rolls, and the separating plate preferably connected by a common rod so that they can all be transversely displaced together. When the format width is changed, the transverse-displacement mechanism will preferably engage the rod, which is in the form of a shaft, at an appropriate point and activate the components of the stacker, which are connected to each other by the rod or shaft, as one unit across the paper path into the new end position. This transverse displacement will preferably be motorized.

The stacker components are guided along by guide rods that will preferably extend through a framework formed of uprights and longitudinal struts that run between them.

The transverse-displacement drive will preferably be mounted on the rod that guides the transverse movement of the separating shoe, which does not move along the paper path, with the other components of the stacker being guided parallel by cog mechanisms. This will ensure an exactly parallel motion across the paper path when the format width is changed.

Another preferred embodiment of the device in accordance with the invention has one stopper board rigidly fastened between each pair of adjacent upper-tape deflection rollers, which are connected in such a way as to move together transversely, and moving along with them when they move transversely. This eliminates the necessity of lifting the upper tapes off the stopper boards during a transverse displacement. The rod may be designed in the form of a shaft and rotated by a motorized transverse-displacement mechanism. There are pinions on the shaft that engage toothed racks to guide the components precisely during a transverse displacement.

When the format length of the sheets of paper is changed, the upper-tape deflection rollers, which are connected by the rod or shaft, can be displaced parallel to the paper path in accordance with the invention to permit access to the stack from the downstream side of the stacker so that sheets that do not lie evenly in the stack or that have been inaccurately cut can be easily removed. The upper-tape deflection rollers are displaced forwards or backwards along the paper path by the shaft, which rotates without axial motion in the upper-tape deflection-roller mounts and is guided by sliding carriers on the separating shoe and the separating plate. This allows displacing the upper-tape deflection rollers parallel to the paper path along with the stopper board, which is connected to the downstream deflection rollers, while leaving the separating plate and the separating shoe in place. The separating plate however can also be displaced independently into the desired position by means of a special mechanism mounted on the rod or shaft. Each stopper board can have a slot through which the separating plate can pass in case the format length is small. This makes it possible to adjust for even small format lengths.

Cogged drive mechanisms will also be practically provided on the longitudinal struts for parallel guiding during longitudinal displacements.

The upstream upper-tape deflection rollers can be guided by lateral guide rails when displaced parallel to the paper path.

When the paper format is wide, it may be practical to disengage some of the separating shoes and separating plates while leaving the upper tapes and stopper boards that work in conjunction with them engaged. The separating shoes and separating plates are accordingly mounted to swing up above the top of the paper stack.

Further details of the paper-stacking device in accordance with the invention will now be specified with reference to the embodiment illustrated in the drawings.

FIG. 1 is a schematic perspective view and

Figure 2:
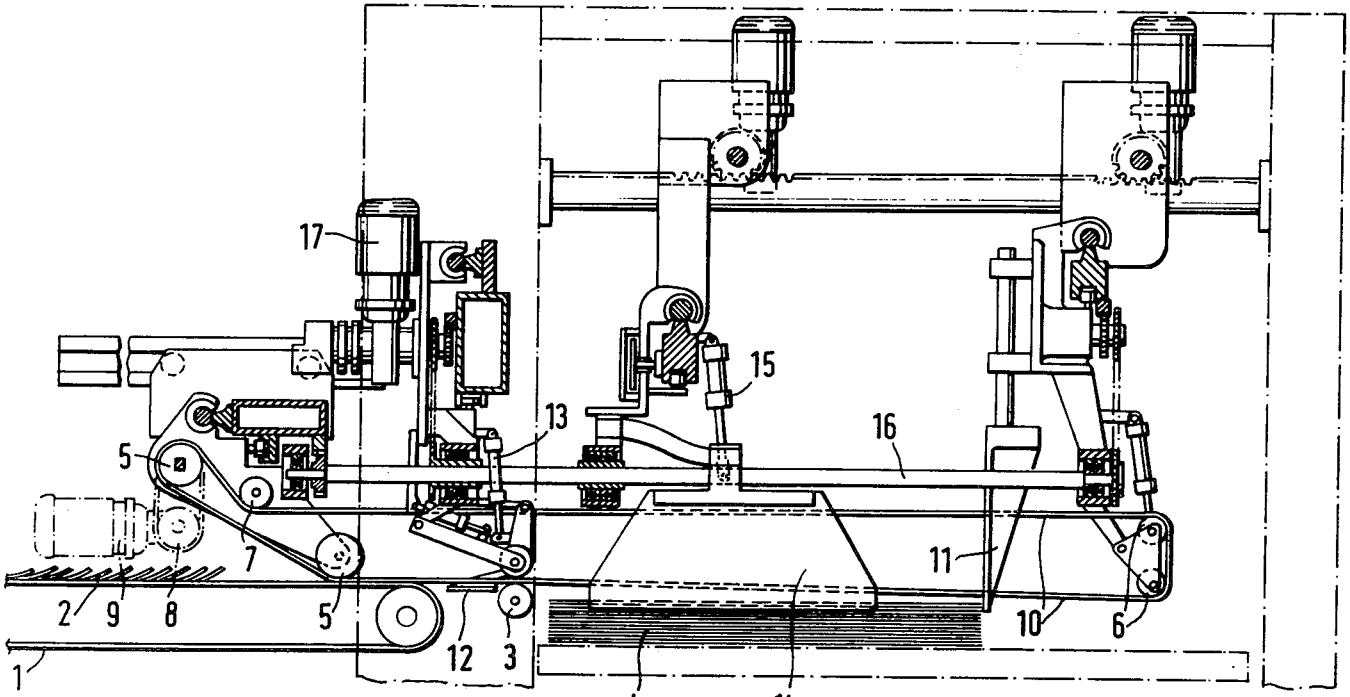

FIG. 2 a side view of the stacking device.

Sheets 2 of paper produced by longitudinally and transversely cutting a web are transported one after the other to the stacking device on a conveyer belt 1. The sheets are supplementally accelerated by ejector rolls 3 downstream of the belt to carry them onto a stack 4. Upper tapes 10, which run over deflection rollers 5 and 6 and are tensioned by tension rollers 7 and powered by drive rollers 8 that are activated by a motor 9, assist in taking the sheets 2 from conveyer belt 1 and guide them through ejector rolls 3 onto stack 4.

Stopper board 11, which is attached to the mount of downstream upper-tape deflection rollers 6, forms the downstream limit for stack 4.

Each pair of upper tapes 10 are connected, along with their deflection rollers, which are mounted as shown most clearly in FIG. 1, in the same bearing block so that they will move together transversely. There is one stopper board 11 between each pair of upper tapes.

There is also a separating shoe 12, which can be lifted above the transport plane of the sheets 2 of paper by a mechanism 13, between each pair of upper tapes 10, between conveyer belt 1 and ejector roll 3. The cross-section of shoes 12 (only one separating shoe 12 is shown in FIG. 1) is wedge-shaped, with the point facing upwards. The function of the shoes is to lift the edges of sheets 2 slightly as they pass by so that each sheet will arrive on stack 4 between two separating plates (lateral jogger blades) 14, however, only one separating plate is shown in FIG. 1. Separating plates 14 can also be raised above the top of stack 4 by a mechanism 15 when they are not needed because the format is too wide.

A stacking unit consists of upper tape or tapes 10, their upstream and downstream deflection rollers 5 or 6, the separating shoe 12 mounted between them, the ejector roll 3, the separating plate 14, and the stopper board 11. The stacking unit positioned along the midline of the paper path has two upper tapes 10, those along the sides of the path one less.

The individual stacking-unit components are, in accordance with the invention, connected by a rod, a square shaft 16 in the embodiment illustrated, so that they all move transversely together. This transverse displacement is initiated by a motorized mechanism 17 that rotates shaft 16 over chain 18 and chain wheels 19. Shaft 16 rotates without axial motion in the mount for the upper-tape deflection-rollers 5 and 6. There are pinions 20 and 21 at each end of the shaft that engage transverse toothed racks 22 and 23 to ensure perfect parallel transverse displacement. Another pinion 24 governs the parallel displacement of a transverse sliding carriage 25 that positions separating shoe 12.

Guide rods 26, 27, 28, and 29, which are mounted on a framework consisting of uprights 31 and of longitudinal struts 32 extending between them, permit the stacker components to move transversely. The guide rod 28 for transverse sliding carriage 25, which positions separating shoe 12, is mounted immovably between two uprights 31. Guide rods 26 and 27, which carry upstream upper-tape deflection rollers 5, are on the other hand mounted to slide longitudinally along lateral guide rails 33, and guide rods 29 and 30, which carry lateral jogger blade 14 or downstream upper-tape deflection rollers 6 and stopper board 11, to slide, powered by drive mechanisms 34 or 35, on longitudinal struts 32 parallel to the paper path, with the parallel guiding carried out by cog mechanisms 36 or 37.

To permit drive mechanism 34 to displace lateral jogger blade 14 parallel to the paper path independent of the other stacker components, blade carriage 38 slides along shaft 16. In other words, shaft 16 can rotate freely in carriage 38 and also permits the carriage to slide along it axially. Separating shoe 12 is also mounted on a carriage 39 on shaft 16 so that, when upper-tape deflection rollers 5 and 6 move longitudinally, shaft 16 can also be displaced longitudinally along with stopper board 11 while separating shoe 12 remains in place. The mounts for upper-tape deflection rollers 5 and 6 are connected by shaft 16, and, when drive mechanism 35 longitudinally displaces them, longitudinal struts 32 and transverse guide rails 33 will move in a parallel direction. Such a longitudinal displacement will occur when the format is short. To permit access to stack 4 from the downstream end of the stacker in such a case, downstream upper-tape deflection rollers 6 will be shifted upstream along with stopper board 11. Stopper boards 11 have a slot 40 through which separating plates 14 can pass so that the paper can be stacked precisely between them even when the format is short.

The stacking device in accordance with the invention is adjusted as follows.

When only the format width of the sheets of paper is to be changed and the stacker components—deflection rollers 5 and 6 plus upper tapes 10, separating shoe 12, ejector rolls 3, separating plate 14, and stopper board 11—will move only transversely, motorized mechanism 17 will be activated in one direction or the other. This will rotate shaft 16 and produce a displacement of all the components together, transversely with respect to the paper path and kept precisely parallel by pinions 20, 21 and 24 with no alterations in the precise alignment of components belonging to one stacking unit. This displacement will occur rapidly and smoothly.

When the format length of the sheets of paper is to be changed and the stacker components are to be moved longitudinally, drive mechanism 34, which adjusts separating plate 14 longitudinally, will displace it upstream or downstream on shaft 16. Drive mechanism 35 may also be activated if necessary to displace stopper board 11, downstream upper-tape deflection rollers 6, which are connected to the stopper board, and upstream upper-tape deflection rollers 5, which are connected to the former components by shaft 16 to provide a common displacement. Longitudinal struts 32 and lateral guide rails 33 provide lateral guidance, with cog mechanisms 36 and 37 preventing lateral jogging plate 14 or stopper board 11 and upper-tape deflection rollers 5 and 6 from tipping when longitudinally displaced.

It will be understood that the specification and examples are illustrative but not limitative of the present invention and that other embodiments within the spirit and scope of the invention will suggest themselves to those skilled in the art.

What is claimed is:

1. A device for stacking sheets of paper for transporting to a stacking station in at least two rows, comprising lower and upper means of conveyance including belts wrapped around deflection rollers and which extend over the stacking station, said station composed of several elements including a separating shoe, a separating plate for each row of paper, said separating plate positioned between each path that the sheets are transported along and acting on the longitudinal edges of the sheets, and stops positioned at the end of the transport path, wherein the upper means of conveyance and the separating shoe and the separating plate that act on the sheets and the stops are adjustable to a particular sheet format, characterized in that the means of conveyance, the separating shoe and the separating plate that act on the longitudinal edges of the sheets, and the stops assigned to each row of sheets are all mounted on first guide rails that extend across the direction in which the sheets are transported in such a way that the sheet size can be adjusted across said direction of transport and in that, the separating shoe, the separating plate, and stops are positioned one after another in a row along the direction of transport and, the means of conveyance are coupled to a common drag shaft that extends along the direction of transport in such way that it entrains the separating shoe and the separating plate, and the stops when the means of conveyance are adjusted across the direction of transport.

2. A device according to claim 1, wherein the upper means of conveyance are belts stretched around deflection rollers and the drag shaft acts as a spacer for pillow blocks of the deflection rollers.

3. A device according to claim 1 wherein the drag shaft is mounted in such a way that it is rotatable and is coupled to at least one transverse-adjustment drive mechanism.

4. A device according to claim 1 wherein the stops and/or the separating plate are adjustable along the direction of transport in relation to the drag shaft.

5. A device according to claim 1 wherein the first guide rails that extend across the direction of transport are laterally mounted on second guide rails that extend along the direction of transport at the side of the transport path.

6. A device according to claim 5 wherein the means of conveyance have a drive mechanism that operates in conjunction with only the second guide rails for adjustments in the direction of transport.

* * * * *